US005125879A

United States Patent [19]

Kuo

[11] Patent Number: 5,125,879

[45] Date of Patent: Jun. 30, 1992

[54] ADJUSTABLE ROLLER STRUCTURE FOR AN EXERCISING STATIONARY BICYCLE

[76] Inventor: Hai-Pin Kuo, Chi-Lu-Chien No. 30, Pao-An-Tsun, Jen-Te Hsian, Tainan Hsein, Taiwan

[21] Appl. No.: 796,364

[22] Filed: Nov. 22, 1991

[51] Int. Cl.[5] ..... A63B 22/00

[52] U.S. Cl. ..... 482/59; 482/111

[58] Field of Search ..... 272/73, 72, 130, 131, 272/132, 93, 71, 70, DIG. 4

[56] References Cited

U.S. PATENT DOCUMENTS 4,565,369 1/1986 Bedgood ..... 272/130

4,743,011 5/1988 Coffey ..... 272/130

5,031,904 7/1991 Solloway ..... 272/130

*Primary Examiner*—Stephen R. Crow

*Attorney, Agent, or Firm*—Morton J. Rosenberg; David I. Klein

[57] ABSTRACT

This invention relates to an adjustable roller structure for an exercising stationary bicycle and in particular to one which includes a driving wheel connected with two pedals, a driven wheel connected with the driving wheel by a belt, a roller mounted on each end of the driven wheel, and an adjusting means having an adjusting screw engaged with a block connected with an arm, whereby the inner disc may be controlled to move towards or away from the outer disc simply by regulating the adjusting screw.

1 Claim, 5 Drawing Sheets

C—C

B—B

A—A

ADJUSTABLE ROLLER STRUCTURE FOR AN EXERCISING STATIONARY BICYCLE

BACKGROUND OF THE INVENTION

It is found that the conventional exercise bicycle which is constructed in the manner of a stationary bicycle with foot pedals, a chain drive system and a flywheel. However, such exercise bicycle is complex in structure and fails to provide a means for adjusting the force required to overcome the resistance in operation.

Therefore, it is an object of the present invention to provide an adjustable roller structure for an exercising stationary bicycle which may obviate and mitigate the above-mentioned drawbacks.

SUMMARY OF THE INVENTION

This invention relates to an adjustable roller structure for an exercising stationary bicycle.

It is the primary object of the present invention to provide an adjustable roller structure for an exercising stationary bicycle which may be adjusted in position for changing the resistance.

It is another object of the present invention to provide an adjustable roller structure for an exercising stationary bicycle which is simple in construction.

It is still another object of the present invention to provide an adjustable roller structure for an exercising stationary bicycle which is economic to produce.

It is still another object of the present invention to provide an adjustable roller structure for an exercising stationary bicycle which is easy to manufacture.

It is a further object of the present invention to provide an adjustable roller structure for an exercising stationary bicycle which is fit for mass production.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
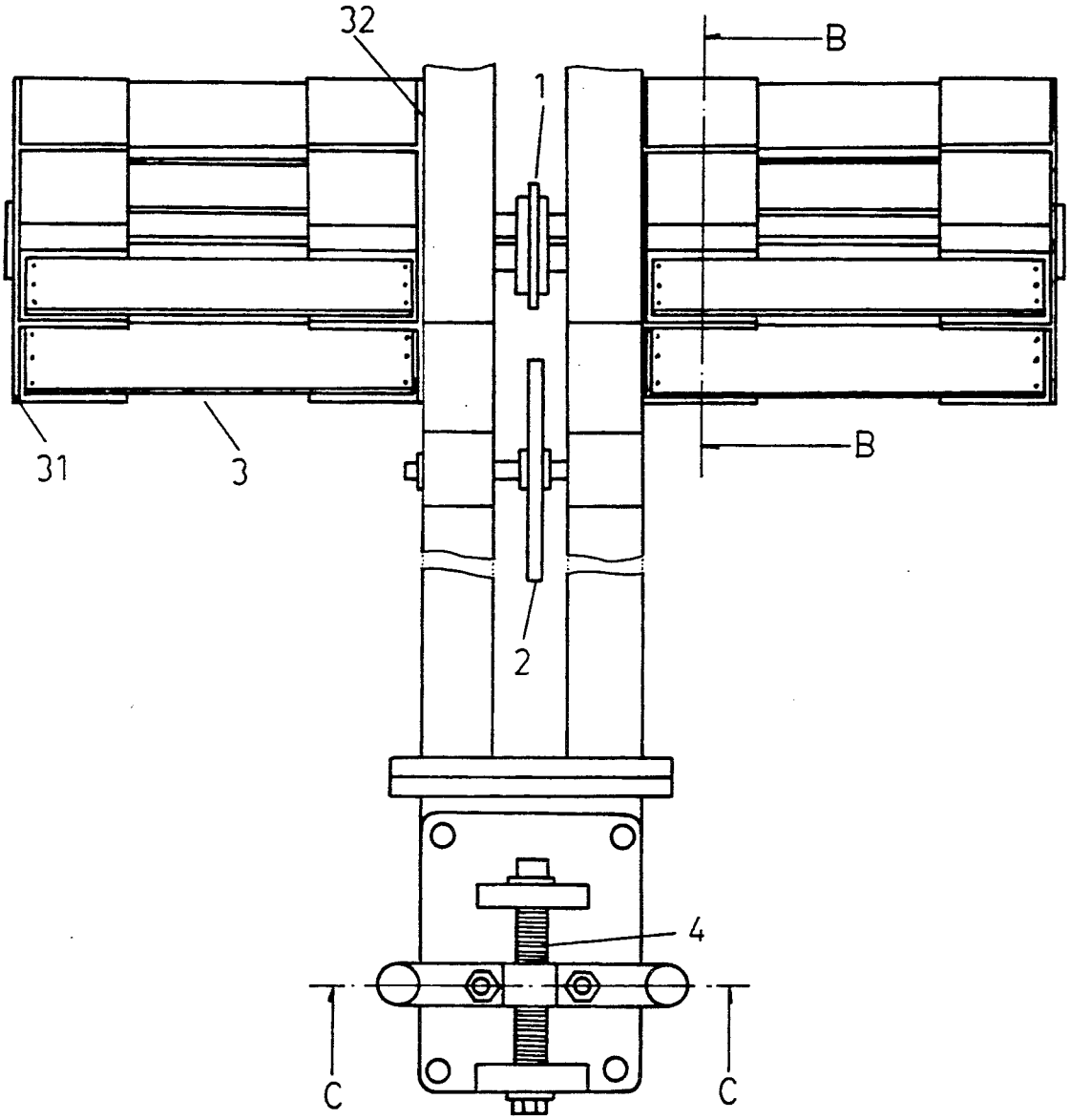
FIG. 1 is a top view of an adjustable roller structure for an exercising stationary bicycle according to the present invention.
Figure 2:
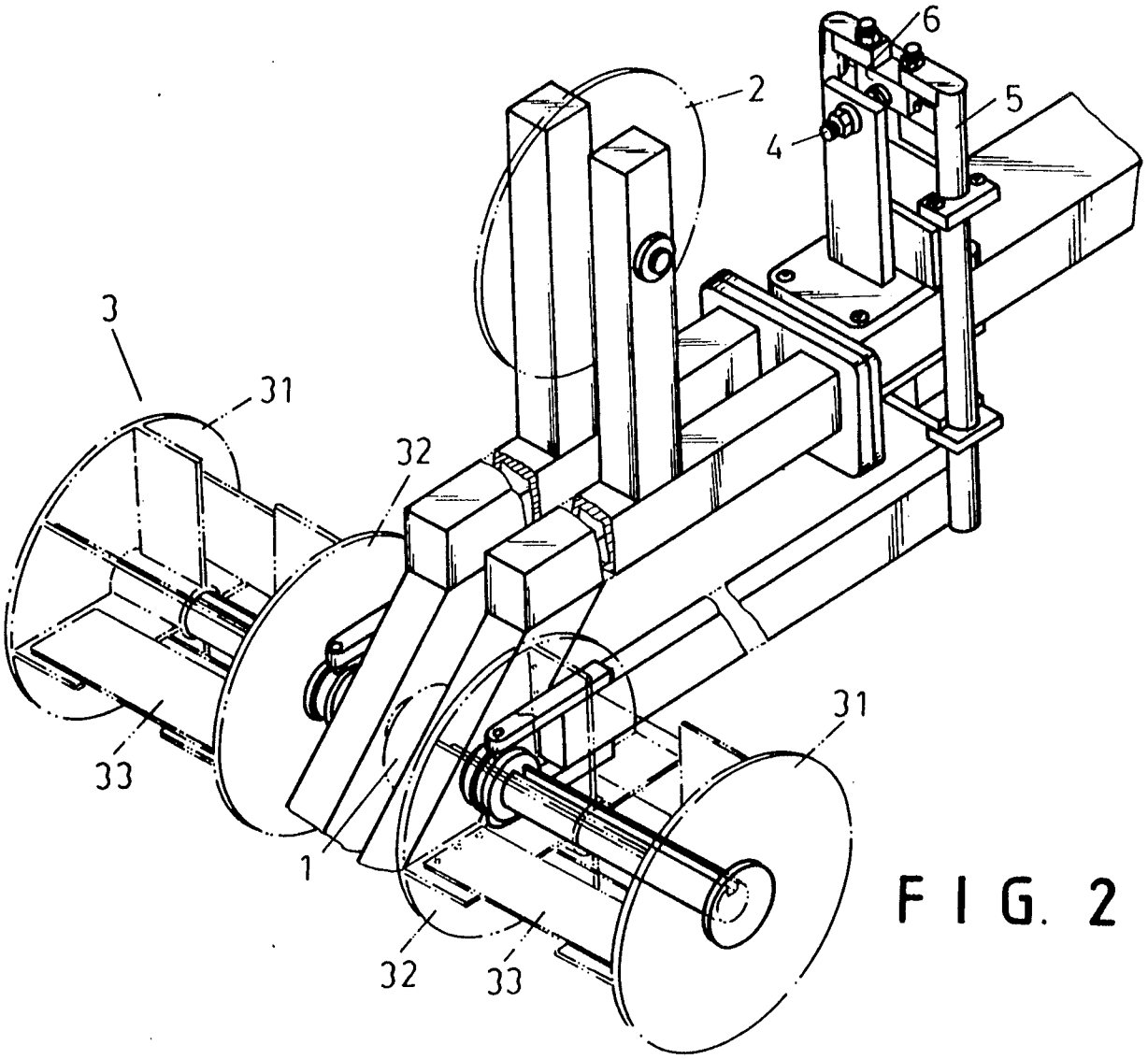
FIG. 2 is a perspective view of the adjustable roller structure for the exercising the stationary bicycle.
Figure 3:
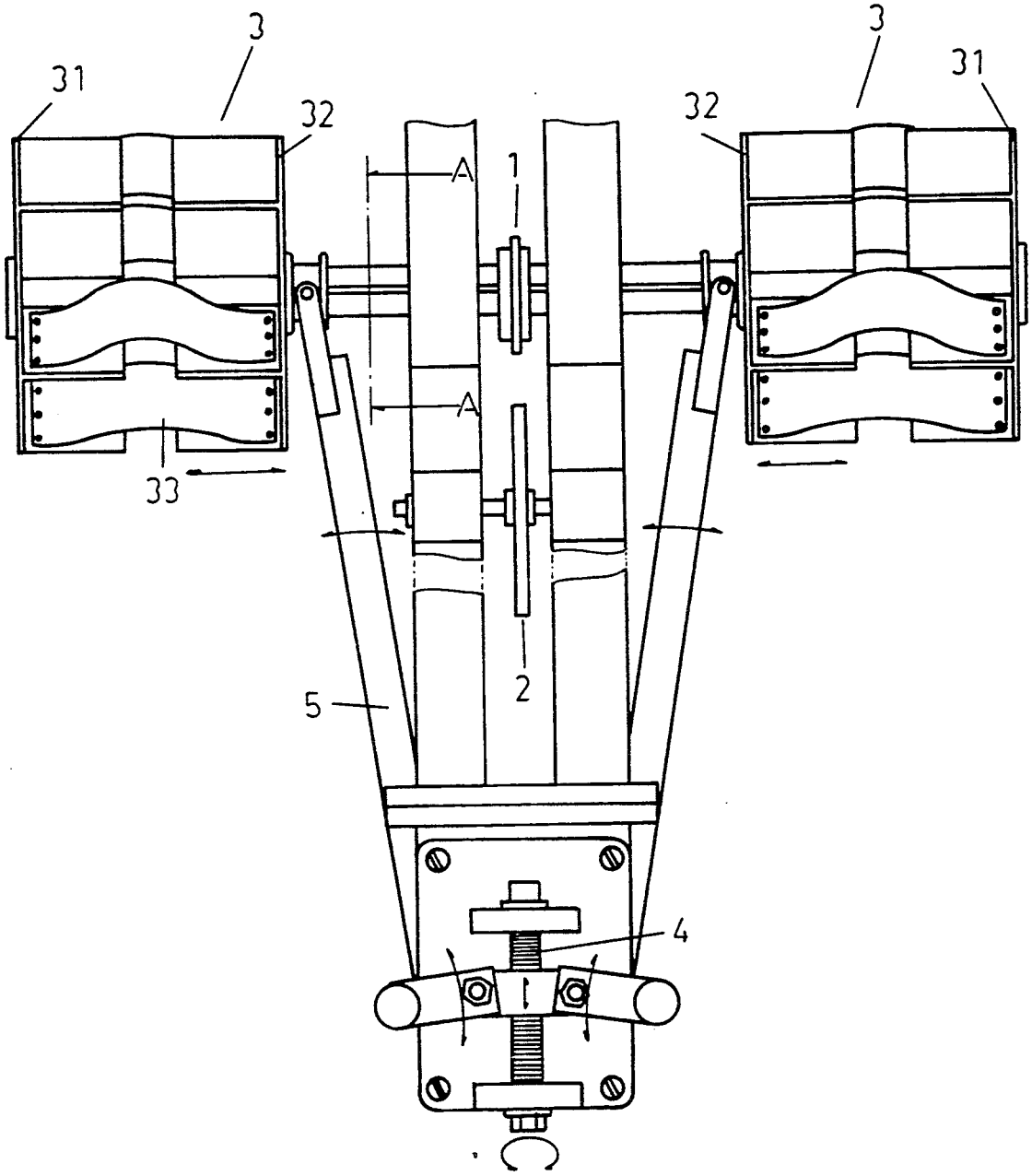
FIG. 3 shows the principle of the adjustable roller structure for the exercisign stationary bicycle.
Figure 6:
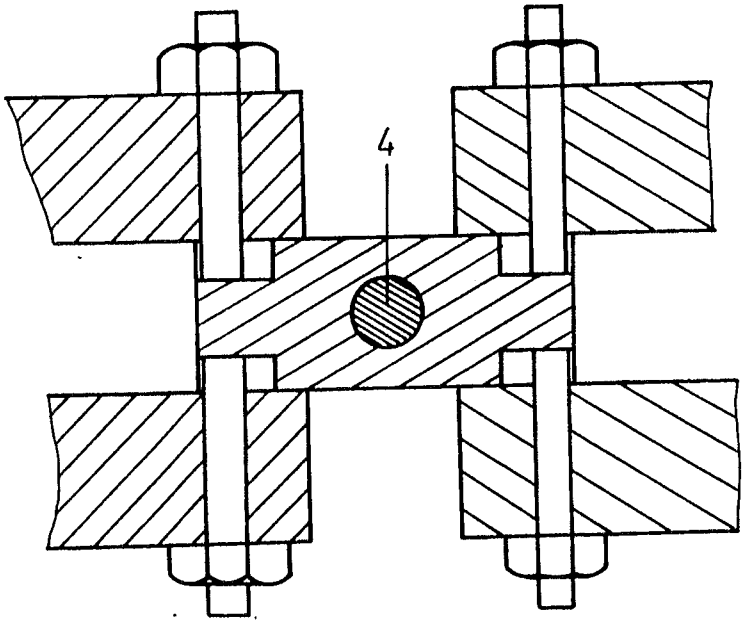
FIG. 6 is a sectional view taken along line C—C of FIG. 1.
Figure 5:
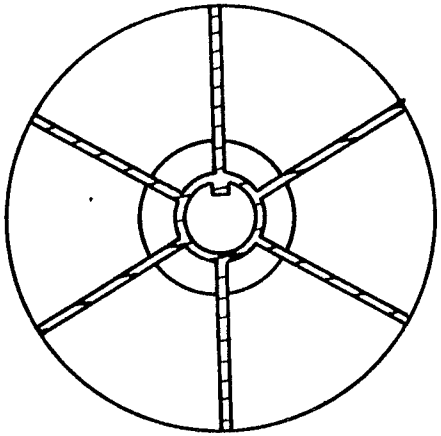
FIG. 5 is a sectional view taken along line B—B of FIG. 1.
Figure 4:
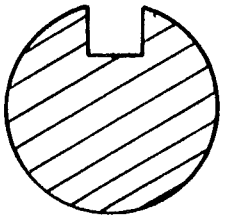
FIG. 4 is a sectional view taken along line A—A of FIG. 3.
Figure 7:
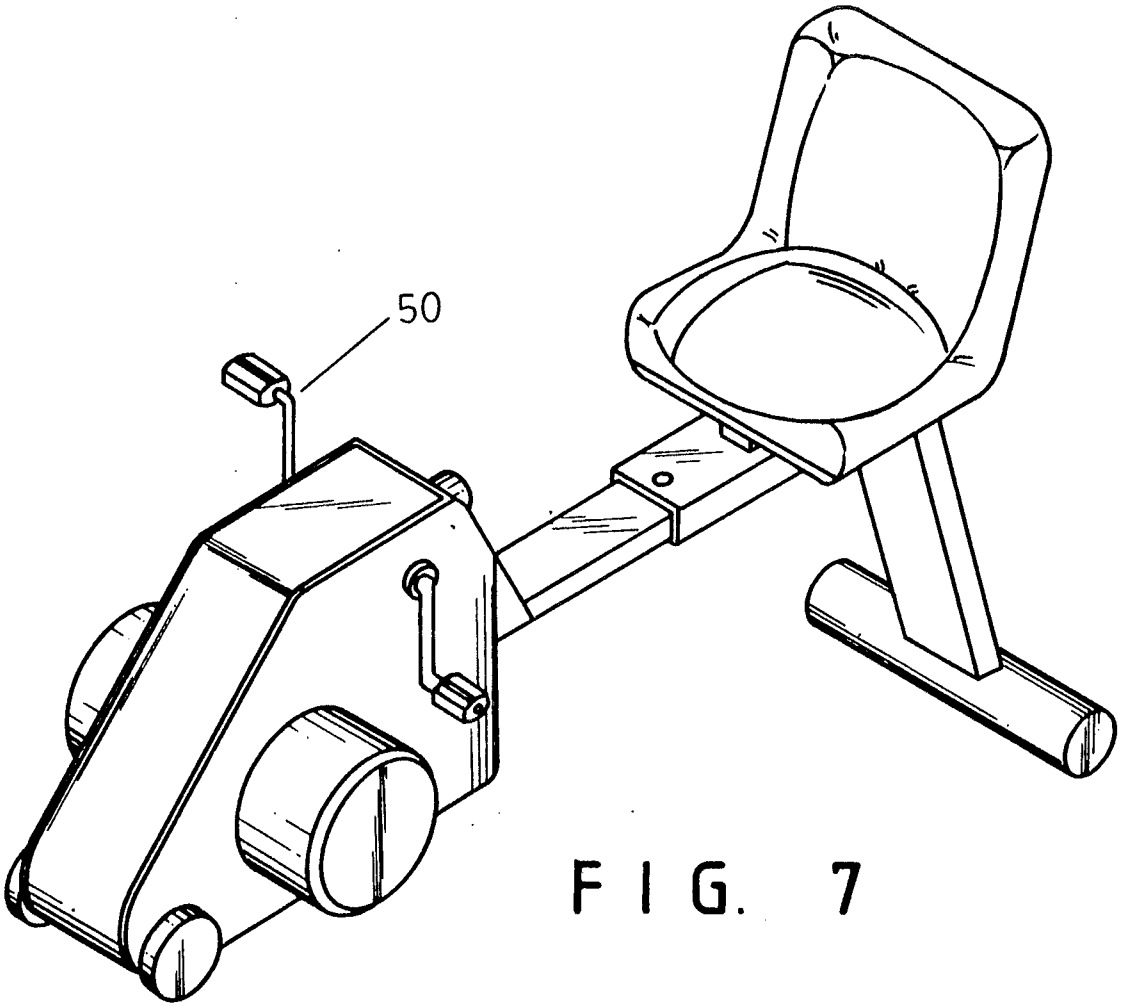
FIG. 7 is a working view of the present invention.

For purpose of promoting an understanding of the principles of the invention, reference will now be made to the embodiment illustrated in the drawings. Specific language will be used to describe the same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

With reference to the drawings and in particular to FIG. 1 thereof, the adjustable roller structure according to the present invention mainly comprises a driven wheel 1 and a driving wheel 2 which are connected by a belt (not shown). The driving wheel 2 is connected with two pedals 50 so that the pedals will rotate the driving wheel 2 which will in turn rotate the driven wheel 1.

On each end of the driven wheel 1 there is mounted a roller 3 which is provided with an outer disc 31 and an inner disc 32. The outer disc 31 is fixedly mounted on an axle 33 while the inner disc 32 is movably mounted on the axle 33. As an adjusting screw 4 is turned to move a block 6, the block 6 will in turn rotate the arm 5. Then, the arm 5 will move the inner disc 32 towards the outer disc 31. Between the inner disc 32 and the outer disc 31 there are a plurality of flexible plates 33 made of plastic or the like. As a result of the discs moving towards each other, the resistance of the roller 3 to the air will be decreased thereby lessening the force required for the user to ride the pedals. Hence, it is convenient to control the resistance of the roller 3 to the air simply by means of adjusting the positioning of the block 6.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. An adjustable roller structure for an exercising stationary bicycle comprising:

a driving wheel connected with two pedals;

a driven wheel mounted on an axle and connected with said driving wheel by a belt;

a pair of rollers mounted on each end of said driven wheel, each said roller having an inner disc and an outer disc, each said outer disc being fixedly mounted on said axle while each said inner disc being movably mounted on said axle;

an adjusting means having an adjusting screw which is engaged with a block connected with a pair of arms; each said arm being connected with a respective said inner disc;

plurality of flexible plates connected between said inner and outer discs;

whereby said inner disc may be controlled to move towards or away from said outer disc simply by regulating said adjusting screw, and thereby deform said plates to vary the air resistance of said rotatable rollers.

* * * * *